US010651584B2

(12) United States Patent
Hsu

(10) Patent No.: US 10,651,584 B2
(45) Date of Patent: May 12, 2020

(54) LOW PROFILE ELECTRICAL CONNECTOR

(71) Applicant: FOXCONN INTERCONNECT TECHNOLOGY LIMITED, Grand Cayman (KY)

(72) Inventor: Shuo-Hsiu Hsu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/014,519

(22) Filed: Jun. 21, 2018

(65) Prior Publication Data

US 2018/0375243 A1 Dec. 27, 2018

(30) Foreign Application Priority Data

Jun. 21, 2017 (CN) ..... 2017 1 0474468

(51) Int. Cl.

| | |
|---|---|
| ***H01R 13/24*** | (2006.01) |
| ***H01R 13/40*** | (2006.01) |
| ***H01R 12/58*** | (2011.01) |
| ***H01R 12/71*** | (2011.01) |
| ***H01R 13/428*** | (2006.01) |
| ***H01R 12/70*** | (2011.01) |

(52) U.S. Cl.

CPC ..... *H01R 13/245* (2013.01); *H01R 12/58* (2013.01); *H01R 12/707* (2013.01); *H01R 12/712* (2013.01); *H01R 13/2442* (2013.01); *H01R 13/40* (2013.01); *H01R 13/428* (2013.01)

(58) Field of Classification Search

CPC ..... H01R 9/096; H01R 12/57; H01R 13/17; H01R 13/2442

USPC ..... 439/66, 74, 862

See application file for complete search history.

(56) References Cited

U.S. PATENT DOCUMENTS

| | | | | |
|---|---|---|---|---|
| 5,860,838 A * | 1/1999 | Kaneko | H01R 13/112 | 439/857 |
| 6,957,964 B2 * | 10/2005 | Chiang | H01R 13/2435 | 439/66 |
| 7,341,485 B2 * | 3/2008 | Polnyi | H01R 13/2435 | 439/591 |
| 7,429,200 B2 * | 9/2008 | Lee | H01R 13/2442 | 439/862 |
| 7,527,536 B2 * | 5/2009 | Chiang | H01R 12/57 | 439/884 |

(Continued)

FOREIGN PATENT DOCUMENTS

CN 201303090 Y 9/2009

*Primary Examiner* — Tulsidas C Patel
*Assistant Examiner* — Marcus E Harcum
(74) *Attorney, Agent, or Firm* — Wei Te Chung; Ming Chieh Chang

(57) ABSTRACT

An electrical connector includes an insulative housing, a plurality of conductive contacts retained in the insulative housing, each contact has a first body, a resilient arm extending upwardly and obliquely from an upper side of the first body, a soldering section extending downwardly from a lower side of the first body, and a second body extending from a lateral side of the first body in an oblique direction and having a retention section formed on an outer lateral side thereof opposite to the first body. The housing forms a receiving cavity for receiving both the first body and the second body, and a retention slot for receiving the retention section.

20 Claims, 8 Drawing Sheets

(56) References Cited

U.S. PATENT DOCUMENTS

| | | | | |
|---|---|---|---|---|
| 7,785,112 | B2 * | 8/2010 | Hashimoto | H01R 13/2435 439/66 |
| 8,366,453 | B2 * | 2/2013 | Chang | H01R 12/58 439/66 |
| 8,454,373 | B2 * | 6/2013 | Cheng | H01R 12/57 439/66 |
| 8,608,491 | B2 * | 12/2013 | Hsu | H01R 13/24 439/66 |
| 2006/0024987 | A1 * | 2/2006 | Huang | H01R 13/2435 439/66 |
| 2006/0040518 | A1 * | 2/2006 | Ma | H01R 13/2442 439/66 |
| 2008/0160841 | A1 * | 7/2008 | Polnyi | H01R 13/2435 439/842 |
| 2009/0156021 | A1 * | 6/2009 | Polnyi | H01R 12/57 439/66 |
| 2009/0263985 | A1 * | 10/2009 | Liu | H01R 13/2457 439/66 |
| 2010/0009557 | A1 * | 1/2010 | Hsiao | H01R 13/2442 439/66 |
| 2010/0184334 | A1 * | 7/2010 | Ma | H01R 13/2442 439/626 |
| 2012/0178298 | A1 * | 7/2012 | Jin | H01R 12/714 439/626 |
| 2012/0178306 | A1 * | 7/2012 | Ju | H01R 12/57 439/660 |
| 2012/0225586 | A1 * | 9/2012 | Tsai | H01R 13/2442 439/626 |
| 2013/0273779 | A1 * | 10/2013 | Liu | H01R 13/2428 439/626 |

* cited by examiner

LOW PROFILE ELECTRICAL CONNECTOR

BACKGROUND OF THE INVENTION

1. Field of the Invention

The present invention relates to an electrical connector, and more particularly to an electrical connector having a low profile thereof with efficiently resilient contacting arms thereof.

2. Description of the Prior Art

U.S. Pat. Nos. 6,652,329 and 7,563,107 disclose the contact of the electrical connector having the contacting section and the retention section with the associated soldering section located in different planes oblique to each other. Chinese Patent No. CN201303090Y also discloses the contact of the electrical connector having the retention section and the contacting section with the associated soldering section located at different planes oblique to each other. Anyhow, all aforementioned designs are not fit for the low profile socket of the connector.

Therefore, an improved electrical connector is highly desired to meet the low profile requirement.

SUMMARY OF THE INVENTION

An object of the present invention is to provide an electrical connector of a low profile configuration with the corresponding contacts having reliable retention and sufficient resiliency thereof.

In order to achieve above-mentioned object, an electrical connector includes an insulative housing, a plurality of conductive contacts retained in the insulative housing, Each contact has a first body, a resilient arm extending upwardly and obliquely from an upper side of the first body, a soldering section extending downwardly from a lower side of the first body, and a second body extending from a lateral side of the first body in an oblique direction and having a retention section formed on an outer lateral side thereof opposite to the first body. The housing forms a receiving cavity for receiving both the first body and the second body, and a retention slot for receiving the retention section. The first body and the second body are linked with each other via a curved connection section which is closer to the soldering section so as to have the upper portion of the first body deflectable for cooperation with the resilient arm. A linking groove connects the receiving cavity and the retention slot, in which the abutting tabs formed on the outer lateral side of the second body are received.

Other objects, advantages and novel features of the invention will become more apparent from the following detailed description of the present embodiment when taken in conjunction with the accompanying drawings.

DESCRIPTION OF THE EMBODIMENT

Figure 1:
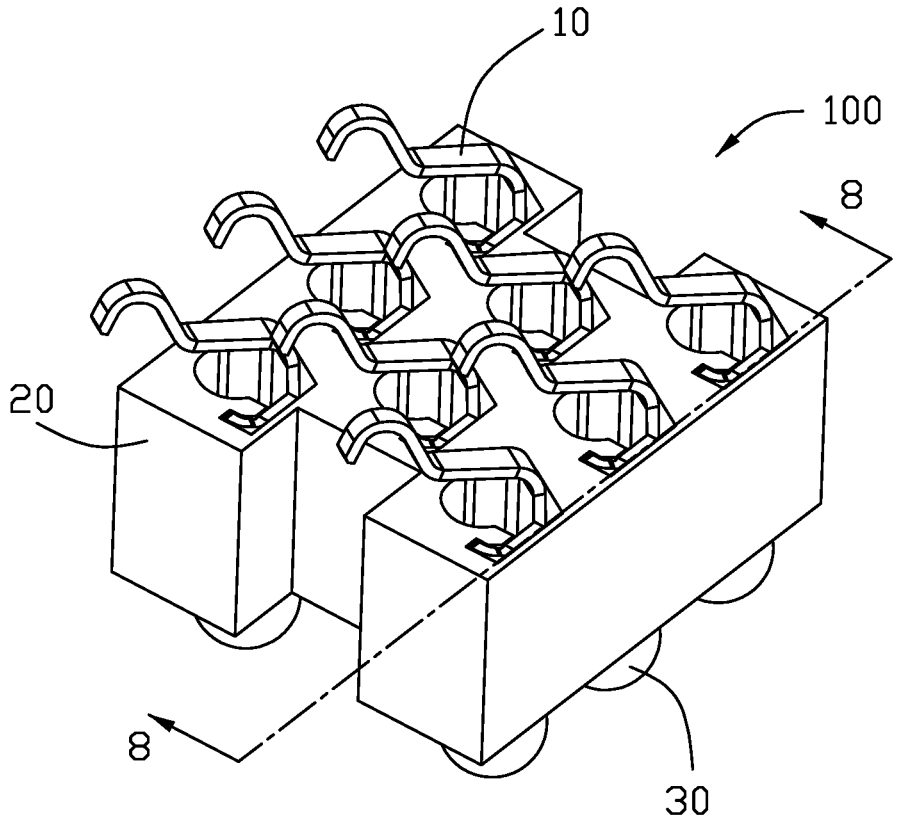
FIG. 1 is a perspective view showing an electrical connector in accordance with the present invention.
Figure 2:
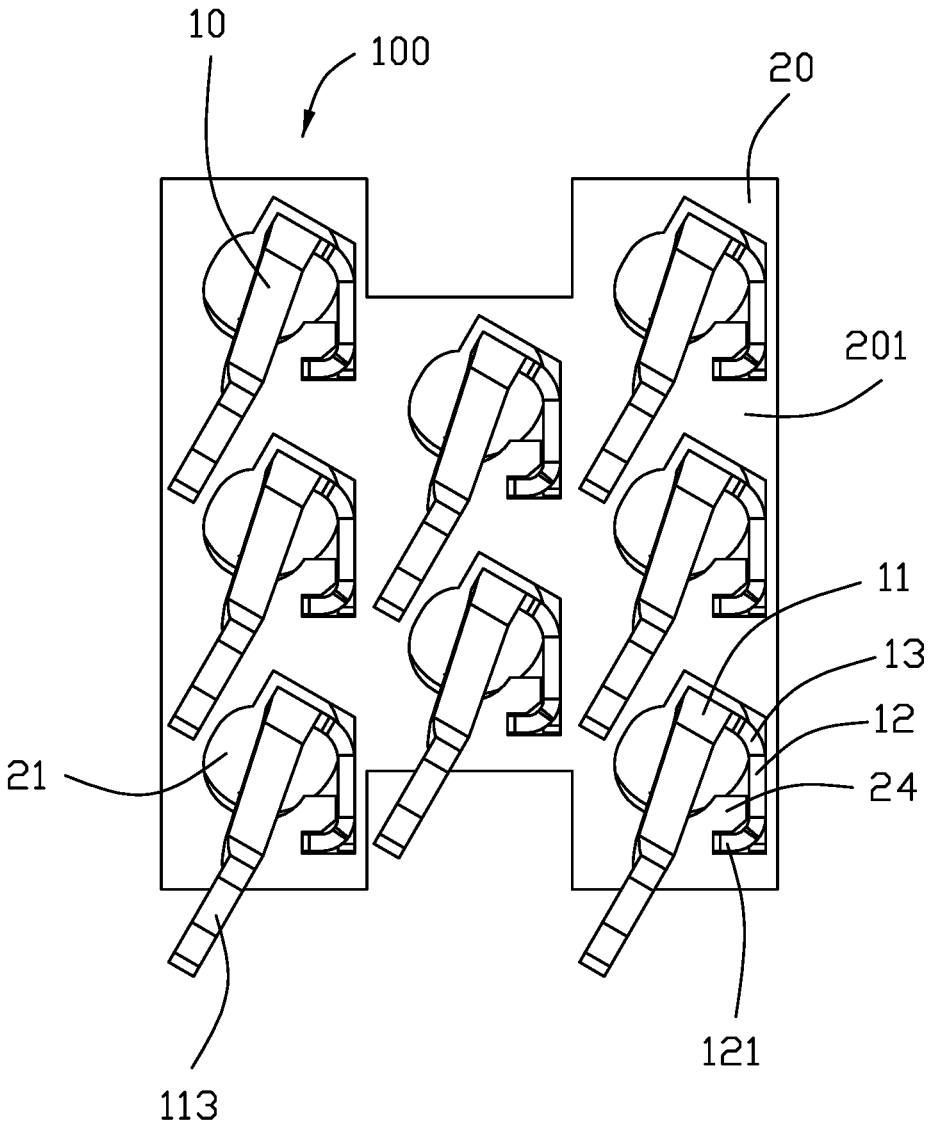
FIG. 2 is a top view of the electrical connector of FIG. 1.
Figure 3:
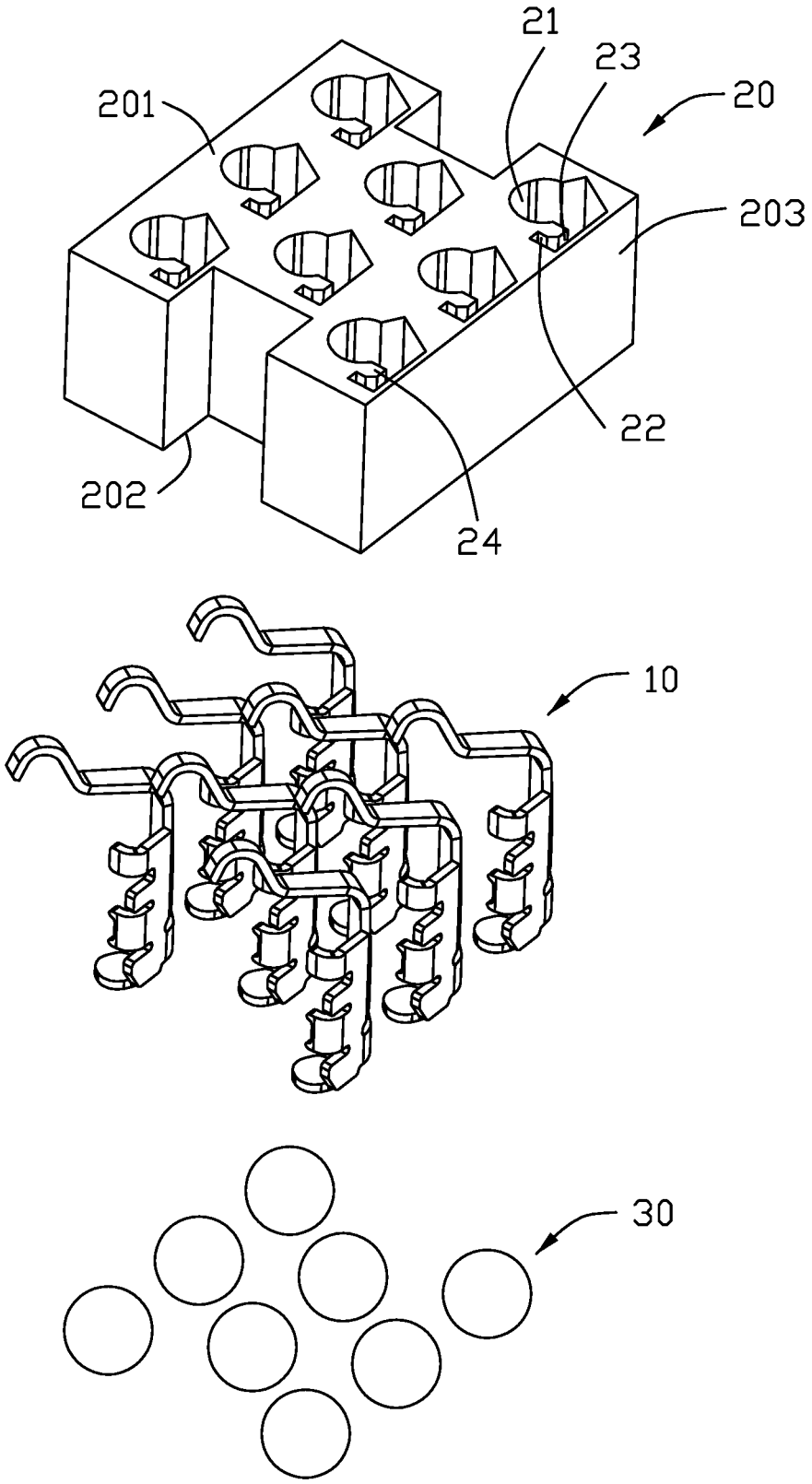
FIG. 3 is an exploded perspective view of the electrical connector of FIG. 1.
Figure 4:
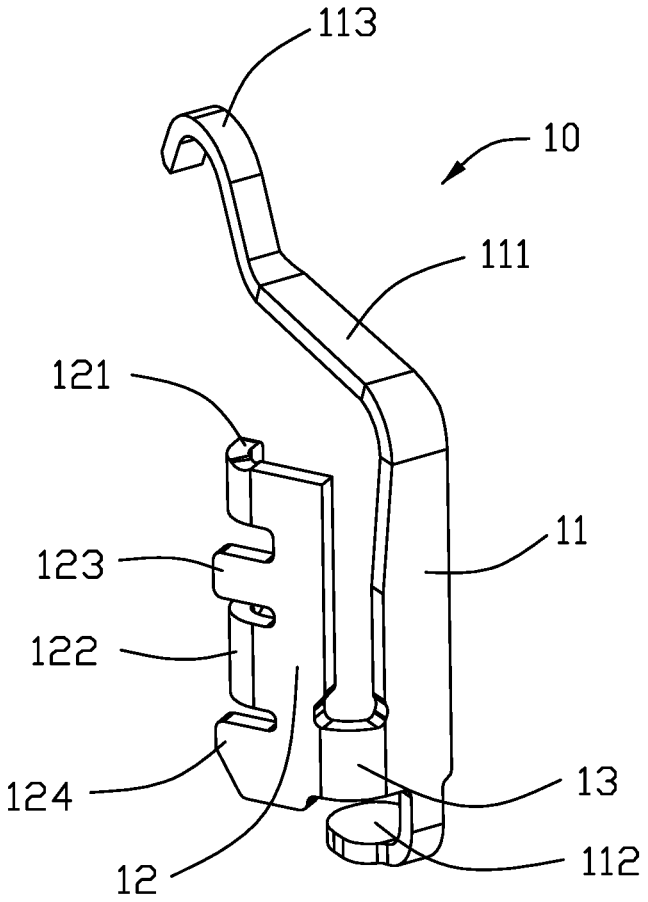
FIG. 4 is a perspective view of the contact of the electrical connector of FIG. 1.
Figure 5:
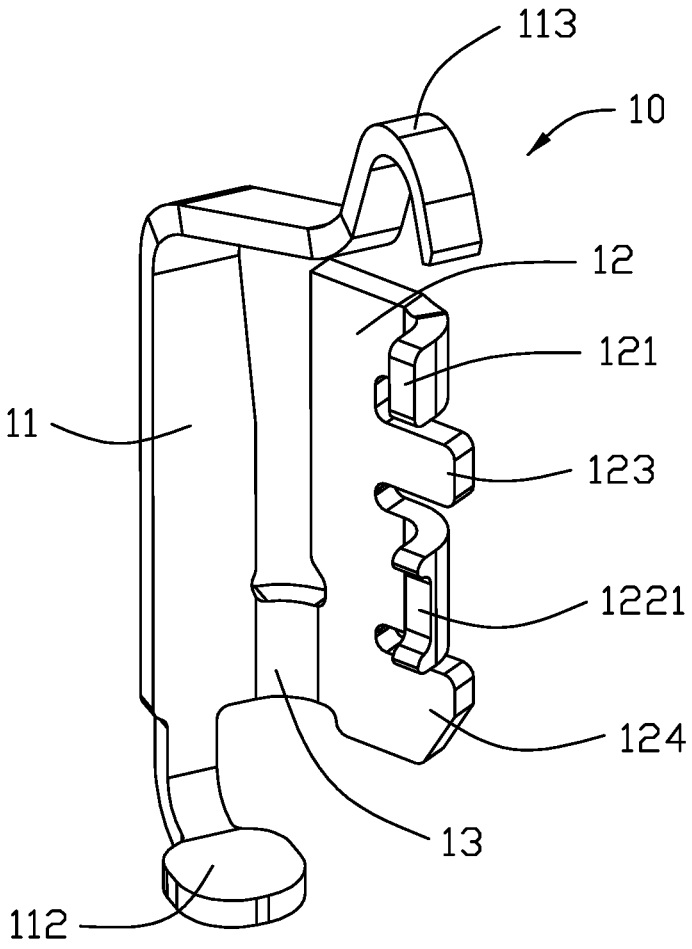
FIG. 5 is another perspective view of the contact of FIG. 4.
Figure 6:
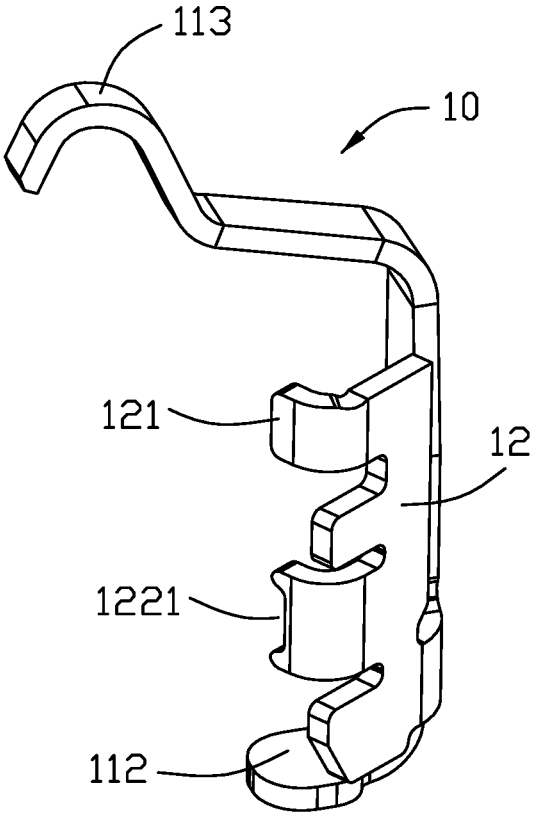
FIG. 6 is another perspective view of the contact of FIG. 5.
Figure 7:
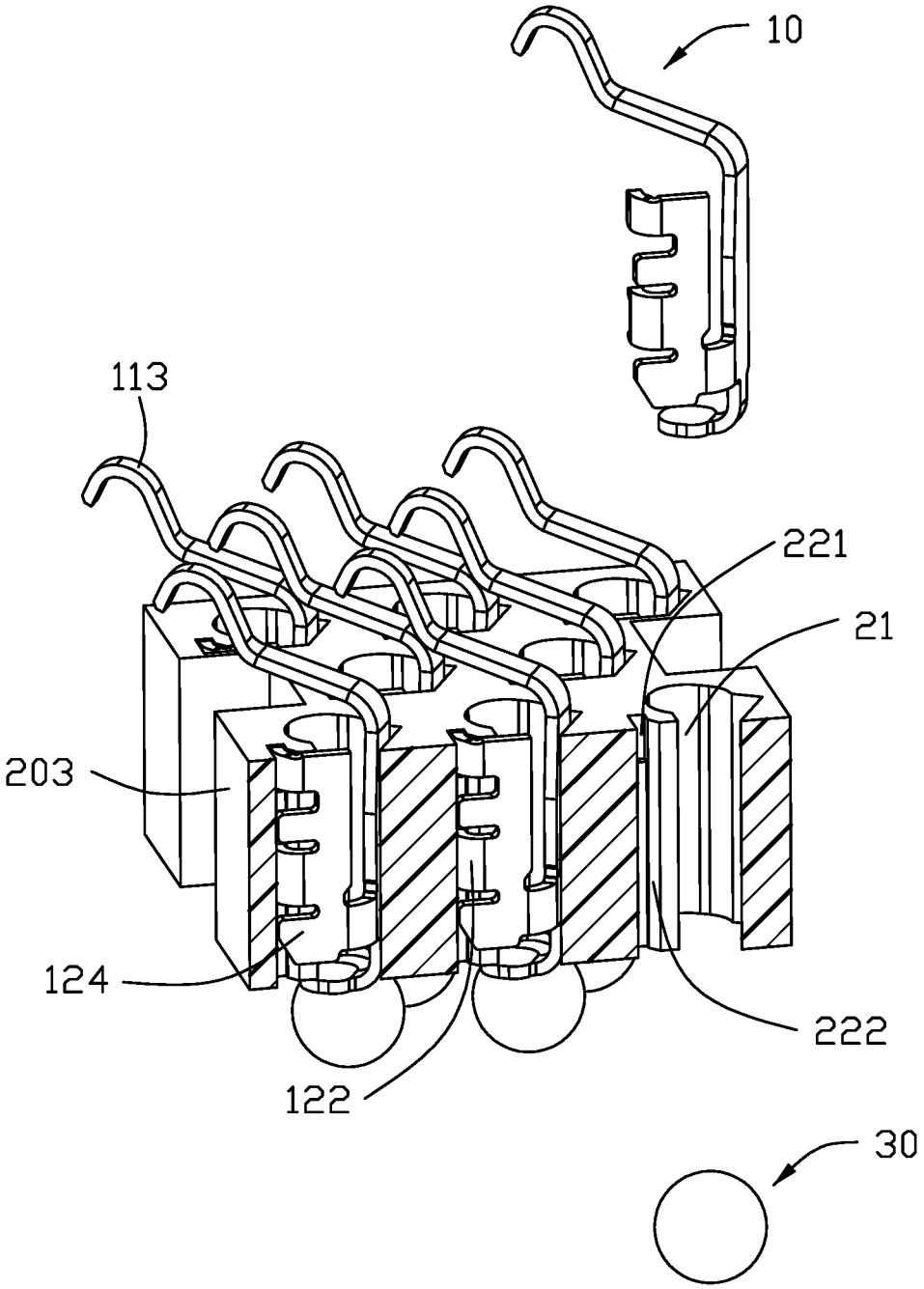
FIG. 7 is a cross-sectional perspective view of the electrical connector of FIG. 5 along line 7-7.
Figure 8:
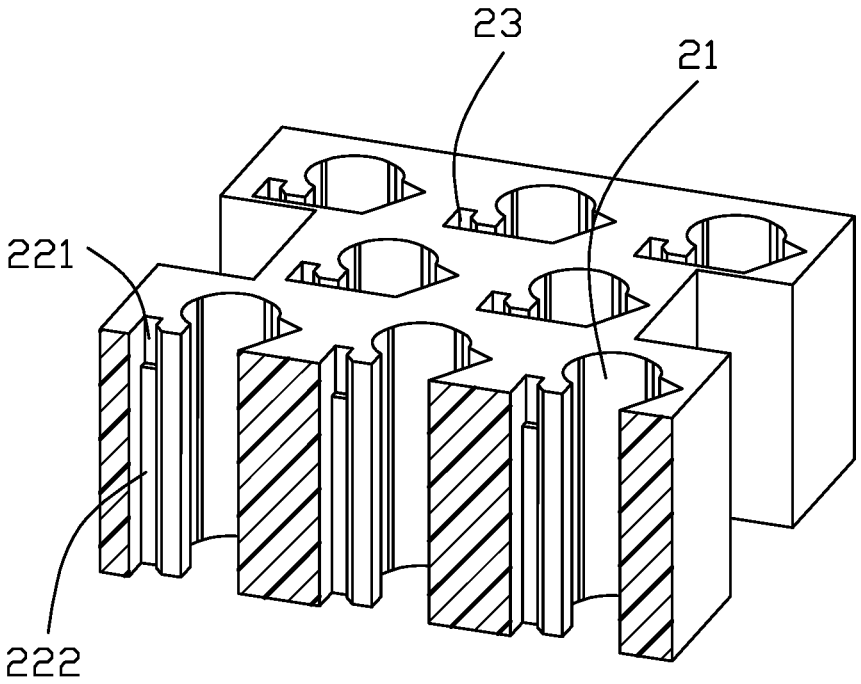
FIG. 8 is a cross-sectional perspective view of the electrical connector without the contacts therein.

Reference will now be made to the drawing figures to describe a preferred embodiment of the present invention in detail. Referring to FIG. 1 to FIG. 8, an electrical connector 100 for connecting the CPU (Central Processing Unit) (not shown) to the printed circuit board (not shown), includes an insulative housing 20, a plurality of contacts 10 and a plurality of solder balls 30 attached to the corresponding contacts 10, respectively.

The contact 10 includes a first body 11, a second body 12 and a connection section 13 linked therebetween. A first retention section 121 and a second retention section 122, and a first abutting tab 123 and a second abutting tab 124 are alternately formed on an outer lateral side of the second body 12 opposite to the first body 11. The housing 20 forms a plurality of receiving cavities 21 each of which receives the first body 11 and the second body 12 of the corresponding contact 10, and a plurality of retention slots 22 each of which receives the first retention section 121 and the second retention section 122 of the corresponding contact 10. Notably, the first retention section 121 and the second retention section 122 on the outer lateral edge/side of the second body 12 extend curvedly toward the first body 11.

The insulative housing 20 includes a linking groove 23 connecting the receiving cavity 21 with the retention slot 22 to snugly receive the first retention section 121, the second retention 122 the first abutting tab 123 and the second abutting tab 124. The housing 20 includes a top wall 201, a bottom wall 202 and side walls 203 connected between the top wall 201 and the bottom wall 202. The receiving cavity 21 extends through the top wall 201 and the bottom wall 202. Understandably, the receiving cavity 21 and the corresponding retention slot 22 with the associated linking groove 23 therebewteen commonly form the contact receiving passageway (not labeled) for receiving the whole contact 10. The housing 20 forms a plurality of blocks 24 beside the corresponding linking grooves 23 for pressing the first retention sections 121, the second retention section 122, the first abutting tab 123 and the second abutting tab 124. In the top view, the second body 12 abuts against an interior surface of the receiving cavity 21 parallel to the side wall 203 while the first body 11 is spaced from the interior surface of the receiving cavity 21 when no CPU presses the contact 10. Anyhow, when the CPU downwardly presses the contact 10, the first body 11 may abut against the interior surface of the receiving cavity 21. This resulting abutment may reinforce the resilient force during deflection of the contact 10.

The first body 11 and the second body 12 is oblique to each other in a top view. A resilient arm 111 extends upwardly and obliquely from an upper side of the first body with a contacting section 113 around the free end, and a soldering section 112 extends horizontally at a lower side of the first body 11, on which the solder ball 30 is attached. The connection section 13 is closer to the soldering section 112, thus providing relatively longer resilient length of the first body 11 for cooperating with the resilient arm 111.

As mentioned before, the first retention section 121 and the second retention section 122 extends firstly away from the first body 11 and successively toward the resilient arm 111. The second retention section 122 section forms a notch 1221 while the first retention section 121 extends beyond the second retention section 122. The retention slot 22 is essentially composed of the first retention slot 221 to snugly and compliantly receive the first retention section 121 in an interferential fit, and the second retention slot 222 shallower than the first retention slot 221 to snugly and compliantly receive the second retention section 122 in an interferential fit. Notably, because of the notch 1221 in the second retention section 122, the second retention section 122 may slide downwardly along the second retention slot 222 when the resilient arm 111 and the associated contacting section 113 of the contact 10 is downwardly pressed by the CPU.

Understandably, different from the traditional barb structure which forms on two opposite sides/edges of the planar retention section in a linear type abutment, in the invention on one hand the retention section the outer edges of the first retention section 121 and the second retention section 122 interfere within the corresponding retention slot 211 while on the other hand the planar type abutment occurs between the second body 12 and the corresponding interior surface of the receiving cavity 21. In other words, the traditional arrangement only performs the interference in a planar manner while the invention performs the three dimensional interference. Moreover, the first and second abutting tabs 123, 124 extend along the same plane with the second body 12 and away from the first body 11 to reinforce the stability of the retention between the contact 10 and the housing 20. Notably, because the first retention section 121 and the second retention section 122 curved extend from the lateral outer side edge of the second body 12 at an angle viewed in the top view, there is no need to form the corresponding barbs on an outer lateral side edge of the first body 11 opposite to the connection section 13, thus easing assembling arrangement.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector comprising:

an insulative housing defining opposite top and bottom wall in a vertical direction;

a plurality of contact receiving passageways formed in the housing, each of said contact receiving passageways including a receiving cavity and a retention slot communicating with each other; and a plurality of contacts disposed in the corresponding contact receiving passageways, respectively, each of said contacts including unitarily a first body and a second body transversely connected to and obliquely angled with each other when viewed in the vertical direction and commonly received within the corresponding receiving cavity, and a retention section unitarily extending from an outer lateral side edge of the second body, transversely spaced from and opposite to the first body, and received within the corresponding retention slot in an interference fit; wherein said retention section extends in a plane which is angled with regard to the second body when viewed in the vertical direction; wherein a resilient arm extends from an upper side of the first body with a contacting section thereof; wherein the second body constantly abuts against an interior surface of the receiving cavity opposite to said retention section; wherein the retention section is equipped with barbed structures only on an outer lateral side edge thereof opposite to the second body for engagement within the retention slot.

2. The electrical connector as claimed in claim 1, wherein the first body is spaced from an interior surface of the receiving cavity when the contact is in a relaxed manner.

3. The electrical connector as claimed in claim 1, wherein the second body further includes another retention section extending from the outer lateral side edge in said plane below said retention section.

4. The electrical connector as claimed in claim 3, wherein said retentions section extends longer than said another retention section.

5. The electrical connector as claimed in claim 3, wherein said another retention section forms a notch therein.

6. The electrical connector as claimed in claim 1, wherein said second body further includes an abutting tab extending from said outer lateral side edge and being coplanar with the second body.

7. The electrical connector as claimed in claim 1, wherein said first body abuts against an interior surface of the receiving cavity when the contact is pressed in the vertical direction.

8. The electrical connector as claimed in claim 1, wherein a soldering section extending from a lower side of the first body with a solder ball attached thereon.

9. The electrical connector as claimed in claim 8, wherein a connection section is linked between the first body and the second body adjacent to the soldering section.

10. The electrical connector as claimed in claim 1, wherein in each of said contact receiving passageways, a linking groove is connected between the corresponding receiving cavity and retention slot.

11. The electrical connector as claimed in claim 10, wherein the linking groove snugly receives the retention section of the corresponding contact.

12. An electrical connector comprising:

an insulative housing defining opposite top and bottom wall in a vertical direction;

a plurality of contact receiving passageways formed in the housing, each of said contact receiving passageways including a receiving cavity and a retention slot communicating with each other; and a plurality of contacts disposed in the corresponding contact receiving passageways, respectively, each of said contacts including unitarily a first body and a second body transversely connected to and obliquely angled with each other when viewed in the vertical direction and commonly received within the corresponding receiving cavity, and a retention section unitarily extending from an outer lateral side edge of the second body and snugly and compliantly received within the corresponding retention slot in an interference fit; wherein the second body constantly abuts against an interior surface of the receiving cavity so as to cooperate with the retention section to retain the contact in the contact receiving passageway while the first body is spaced from any interior surface of the receiving cavity when the contact is in a relaxed manner; wherein a resilient arm extends from the first body with a contacting section thereof; wherein said retention section is transversely spaced and extending away from and opposite to the first body; wherein said retention section forms a curved structure joined with the outer lateral side edge of the second body viewed in the vertical direction.

13. The electrical connector as claimed in claim 12, wherein said second body further includes an abutting tab extending from said outer lateral side edge and being coplanar with the second body.

14. The electrical connector as claimed in claim 12, wherein said first body abuts against said interior surface of the receiving cavity when the contact is pressed in the vertical direction.

15. The electrical connector as claimed in claim 12, wherein said resilient arm extends from an upper side of the first body, and a soldering section extending from a lower side of the first body with a solder ball attached thereon.

16. The electrical connector as claimed in claim 15, wherein only a connection section is linked between the first body and the second body adjacent to the soldering section.

17. An electrical connector comprising:

an insulative housing defining opposite top and bottom wall in a vertical direction;

a plurality of contact receiving passageways formed in the housing, each of said contact receiving passageways including a receiving cavity and a retention slot communicating with each other; and a plurality of contacts disposed in the corresponding contact receiving passageways, respectively, each of said contacts including unitarily a first body and a second body transversely connected to and obliquely angled with each other when viewed in the vertical direction and commonly received within the corresponding receiving cavity, a retention section unitarily extending from an outer lateral side edge of the second body, transversely spaced and extending away from and opposite to the first body, and snugly and compliantly received within the corresponding retention slot in an interference fit, and an abutting tab unitarily extending from said outer lateral side edge of the second body; wherein said retention section and said abutting tab extend in two different planes; wherein said abutting tab extends coplanar with the second body while said retention section extends in the plane which is angled with the second body.

18. The electrical connector as claimed in claim 17, wherein the first body is spaced from any interior surface of the receiving cavity when the contact is in a relaxed manner.

19. The electrical connector as claimed in claim 17, wherein the contact further includes a resilient arm extending upwardly from an upper end of the first body with a contacting section around a free end thereof and a soldering section extending around a lower end of the first body, and the first body and the second body are only linked by only a connection section which is located close to the soldering section, thus providing a relatively longer resilient length of the first body for cooperating with the resilient arm.

20. The electrical connector as claimed in claim 17, wherein said abutting tab faces away from the first body.

* * * * *